US010566162B2

(12) United States Patent
Long et al.

(10) Patent No.: US 10,566,162 B2
(45) Date of Patent: Feb. 18, 2020

(54) LEAKAGE PROTECTIVE PLUG

(71) Applicant: Foshan Shunde District Xinhuida Electronics Co., Ltd., Foshan, Guangdong (CN)

(72) Inventors: Huanxiang Long, Guangdong (CN); Qi Guo, Guangdong (CN)

(73) Assignee: Foshan Shunde District Xinhuida Electronics Co., Ltd., Foshan (CN)

( * ) Notice: Subject to any disclaimer, the term of this patent is extended or adjusted under 35 U.S.C. 154(b) by 84 days.

(21) Appl. No.: 15/832,796

(22) Filed: Dec. 6, 2017

(65) Prior Publication Data

US 2018/0158636 A1 Jun. 7, 2018

(30) Foreign Application Priority Data

Dec. 6, 2016 (CN) ..... 2016 1 1110384
Dec. 6, 2016 (CN) ..... 2016 2 1332892 U

(51) Int. Cl.

| | |
|---|---|
| ***H01R 13/648*** | (2006.01) |
| ***H01H 50/32*** | (2006.01) |
| ***H01H 50/20*** | (2006.01) |
| ***H01R 24/28*** | (2011.01) |
| ***H01R 13/713*** | (2006.01) |
| ***H01H 50/02*** | (2006.01) |
| *H01R 103/00* | (2006.01) |
| *H01R 24/68* | (2011.01) |

(52) U.S. Cl.

CPC ..... *H01H 50/326* (2013.01); *H01H 50/021* (2013.01); *H01H 50/20* (2013.01); *H01R 13/713* (2013.01); *H01R 24/28* (2013.01); *H01H 2235/01* (2013.01); *H01R 24/68* (2013.01); *H01R 2103/00* (2013.01)

(58) Field of Classification Search

CPC .... H01R 13/648; H01R 13/652; H01R 13/66; H01R 13/658; H01R 13/65802
USPC ..... 439/607.01, 95, 620.04
See application file for complete search history.

(56) References Cited

U.S. PATENT DOCUMENTS

| | | | | |
|---|---|---|---|---|
| 2012/0052702 A1* | 3/2012 | Zou | H01R 13/7135 439/95 |
| 2013/0045628 A1* | 2/2013 | Zou | H01R 13/713 439/607.01 |
| 2018/0166833 A1* | 6/2018 | Nie | H01H 73/44 |

FOREIGN PATENT DOCUMENTS

| | | | | |
|---|---|---|---|---|
| CN | 201230073 | * | 4/2009 | H01H 71/24 |
| CN | 201230073 Y | | 4/2009 | |

* cited by examiner

*Primary Examiner* — Abdullah A Riyami
*Assistant Examiner* — Thang H Nguyen

(57) ABSTRACT

A leakage protective plug and a tripping mechanism thereof, comprising a housing, and a tripping mechanism and a conducting structure arranged within the housing, wherein the tripping mechanism comprises a restorable reset button, a tripping bracket, and a tripping coil and a pressing arm arranged in the tripping bracket, wherein the reset button is sleeved in the pressing arm in which a snap fitting mechanism is positioned such that the pressing arm and the reset button may be snapped together, and the pressing arm and the reset button may be disengaged under the control of the tripping coil. It has a simple and reliable structure, and avoids technical problems including poor contact of supply circuit and failure of power leakage protecting functions due to un-complete tripping which are resulted from the deformation of the tripping plate caused by the movement of the tripping iron core and by other external forces.

17 Claims, 6 Drawing Sheets

LEAKAGE PROTECTIVE PLUG

CROSS REFERENCE TO RELATED APPLICATIONS

This application claims priority from Chinese Utility Model Application No. 201621332892.6 and Chinese Patent Application No. 201611110384.8, both filed on Dec. 6, 2016, the entire contents of which are incorporated herein by reference.

FIELD OF THE INVENTION

The present invention relates to the field of plugs, more particularly to a leakage protective plug and a tripping mechanism thereof.

BACKGROUND OF THE INVENTION

In order to cut off the power in time, existing leakage protective plugs usually includes a tripping mechanism.

FIG. 1 illustrates a utility model application No. 200820099570.0, titled as plug having electricity leakage protection function and previously filed by same applicant as the present invention. Therein, a tripping mechanism comprises a pressing bar 2, and a pressing arm 14 and a big reset spring 11 which are sleeved on the pressing bar 2, wherein the pressing arm 14 is upwardly and downwardly movable in relative to the pressing bar 2, a slot 142 is arranged in the middle of the pressing arm 14, an opening of a tripping plate 9 is positioned in the slot of the pressing arm and may be snapped into a retaining groove 21 of the pressing bar 2 so as to integrate a reset button 1 with the pressing arm 14, wherein an iron core 8 may be moved forwardly by the tripping plate 9 under the spring force of a small spring 5. In the case electric leakage occurs, a high-intensity magnetic field is generated by an electromagnetic coil 6, which enables the tripping plate 9 to be quickly pulled by the iron core 8 and meanwhile the small reset spring 5 may be compressed by the tripping plate 9, so that the tripping plate 9 may get away from the retaining groove 21. Then, the pressing bar 2 is moved upwards quickly under the force of the big reset spring 11, whereby cutting off conducting structure and thus shutting off power.

However, the structure of such leakage protection plug as mentioned in the above patent application is complicated that potential security risks usually exist. For example, during using, the deformation of the tripping plate, which is easily caused by the movement of the iron core during tripping or other external forces, results in technical problems including poor contact of supply circuit and failure of power leakage protecting functions due to un-complete tripping. In addition, such leakage protection plug has a low safety coefficient.

SUMMARY OF THE INVENTION

The present invention aims to provide a leakage protective plug and a tripping mechanism thereof which overcome the existing technical problems.

In order to achieve the above goal, the present invention provides a leakage protective plug, comprising a housing, and a tripping mechanism and a conducting structure which are arranged within the housing, wherein the tripping mechanism comprises a restorable reset button, a tripping bracket, and a tripping coil and a pressing arm which are arranged in the tripping bracket, wherein the reset button is sleeved in the pressing arm in which a snap fitting mechanism is positioned such that the pressing arm and the reset button may be snapped together, and the pressing arm and the reset button may be disengaged from each other under the control of the tripping coil.

Preferably, the snap fitting mechanism of the pressing arm comprises a snap fitting sliding groove arranged in the pressing arm and a snap fitting part arranged in the snap fitting sliding groove, and the reset button is upwardly and downwardly slidable in the snap fitting sliding groove and is snap fitted with the snap fitting part.

Preferably, the pressing arm may be rotated an angle under the control of the tripping coil, so as to disengage the reset button from the pressing arm.

Preferably, a slope for allowing the pressing arm to rotate an angle is provided at an end portion on the underside of the pressing arm away from the snap fitting mechanism.

Preferably, an iron core and a spring are arranged within the tripping coil, the pressing arm is provided with a retaining sliding groove on the other side opposite to the snap fitting mechanism, a head part of the iron core is snap fitted in the retaining sliding groove of the pressing arm and is upwardly and downwardly slidable along the inside wall thereof.

Preferably, the reset button may be restored by a reset spring arranged below the reset button.

Preferably, a pressing bar is arranged below the reset button, a reset spring is sleeved on the pressing bar, a retaining groove is arranged on the pressing bar, and the retaining groove and the snap fitting mechanism of the pressing arm may be snapped together.

Preferably, the pressing arm is provided with arms on two sides, respectively, the tripping bracket is provided with opening sliding grooves, and two arms of the pressing arm are positioned in the longitudinal opening sliding grooves.

Preferably, the housing comprises an upper housing and a lower housing which enclose a closed space in which the tripping mechanism and the conducting structure are arranged.

Preferably, the conducting structure comprises a circuit board, movable contact springs for zero connection and fire wire connection, pins for zero connection and fire wire connection, and an cutting sleeve for output lines, wherein the heads of the movable contact springs for zero connection and fire wire connection are movable contacts, the upper ends of the pins for zero connection and fire wire connection are stationary contacts, and the stationary contacts and the movable contacts correspond with each other and are contactable with each other.

Preferably, rear parts of the movable contact springs for zero connection and fire wire connection away from the movable contacts are respectively installed on two sides of the tripping bracket, and the parts with which the movable contacts are connected respectively press against the two arms of the pressing arm.

Preferably, the pins for zero connection and fire wire connection are fixed on the tripping bracket, with two pins protruding from the lower housing.

Preferably, the cutting sleeve for output lines is fixed inside the lower housing through a snap joint.

The present invention also provide a tripping mechanism of a leakage protective plug, characterized in that: the tripping mechanism comprises a restorable reset button, a tripping bracket, and a tripping coil and a pressing arm which are arranged in the tripping bracket, wherein the reset button is sleeved in the pressing arm and a snap fitting mechanism is positioned in the pressing arm such that the pressing arm and the reset button are snapped together, and the pressing arm and the reset button are disengageable under the control of the tripping coil.

Preferably, the snap fitting mechanism of the pressing arm comprises a snap fitting sliding groove arranged in the pressing arm and a snap fitting part arranged in the snap fitting sliding groove, and the reset button is upwardly and downwardly slidable in the snap fitting sliding groove and is snap fitted with the snap fitting part.

Preferably, the pressing arm may be rotated an angle under the control of the tripping coil, so as to disengage the reset button from the pressing arm.

Preferably, a space is provided in the opening of the tripping bracket accommodating the pressing arm so as to allow the pressing arm to be rotated an angle.

Preferably, a slope for allowing the pressing arm to rotate an angle is provided at an end portion on the underside of the snap fitting mechanism.

Preferably, an iron core and a spring are arranged within the tripping coil, the pressing arm is provided with a retaining sliding groove on the other side opposite to the snap fitting mechanism, a head part of the iron core is snap fitted in the retaining sliding groove of the pressing arm and is upwardly and downwardly slidable along the inside wall.

Preferably, the reset button may be restored by a reset spring arranged below the reset button.

Preferably, a pressing bar is arranged below the reset button, a reset spring is sleeved on the pressing bar, the pressing bar is arranged with a retaining groove, and the retaining groove and the snap fitting mechanism of the pressing arm may be snapped together.

Preferably, the pressing arm is provided with arms on two sides, respectively, the tripping bracket is provided with opening sliding grooves, and two arms of the pressing arm are positioned in the longitudinal opening sliding grooves.

Compared with the existing devices, the present invention simplify the structure of the tripping mechanism of the leakage protective plug, involves less components by providing a snap fitting mechanism in the pressing arm instead of a tripping plate and saves raw materials. It also achieves advantages including tripping function and leakage protection for plug. It has a simple and reliable tripping mechanism, and avoids technical problems including poor contact of supply circuit and failure of power leakage protecting functions due to un-complete tripping which are resulted from the deformation of the tripping plate caused by the movement of the tripping iron core and by other external forces. In addition, it extends service life for the leakage protective plug.

DETAILED DESCRIPTION OF ILLUSTRATED EMBODIMENTS

It should be understood that the terms such as "upward", "downward", "forward" and "rearward" as used herein, refer to position and orientation relationships in accordance with drawings and are not intended to limit the particular configuration and operation of the present invention. As such, it is intended that the foregoing be regarded as illustrative rather than limiting.

The present invention will be further explained below in detail with reference to figures and particular embodiments.

Figure 1:
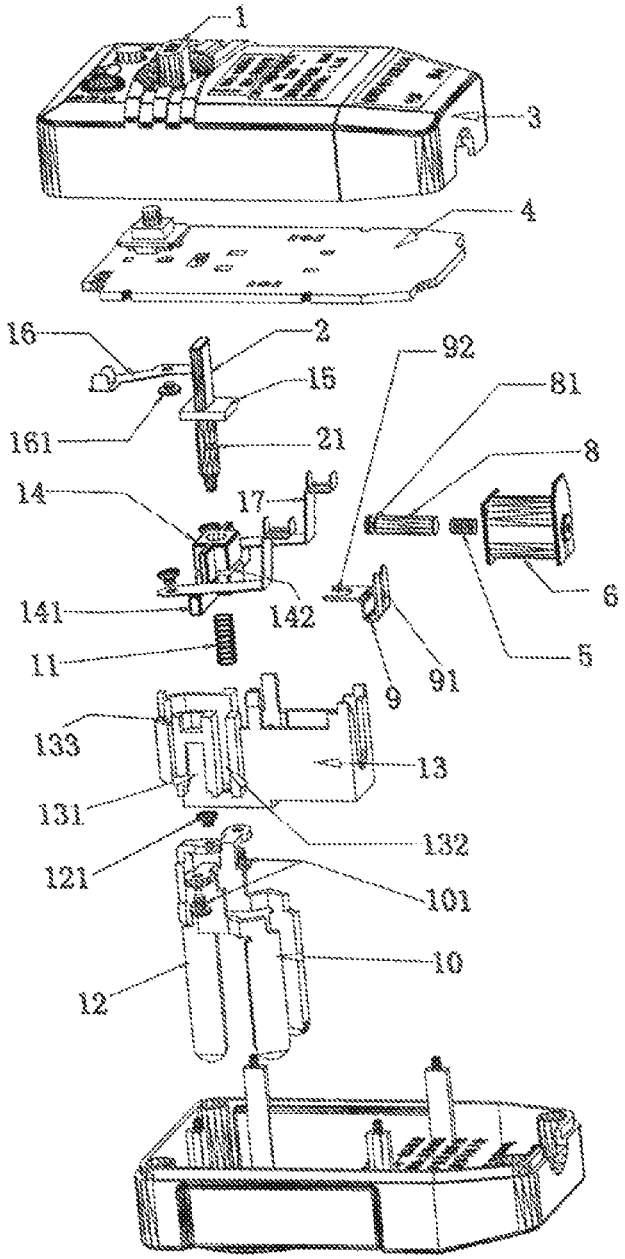
FIG.1 (PRIOR ART)
FIG. 1 is an exploded view of a structure according to patent application No. 200820099570.0.
Figure 2:
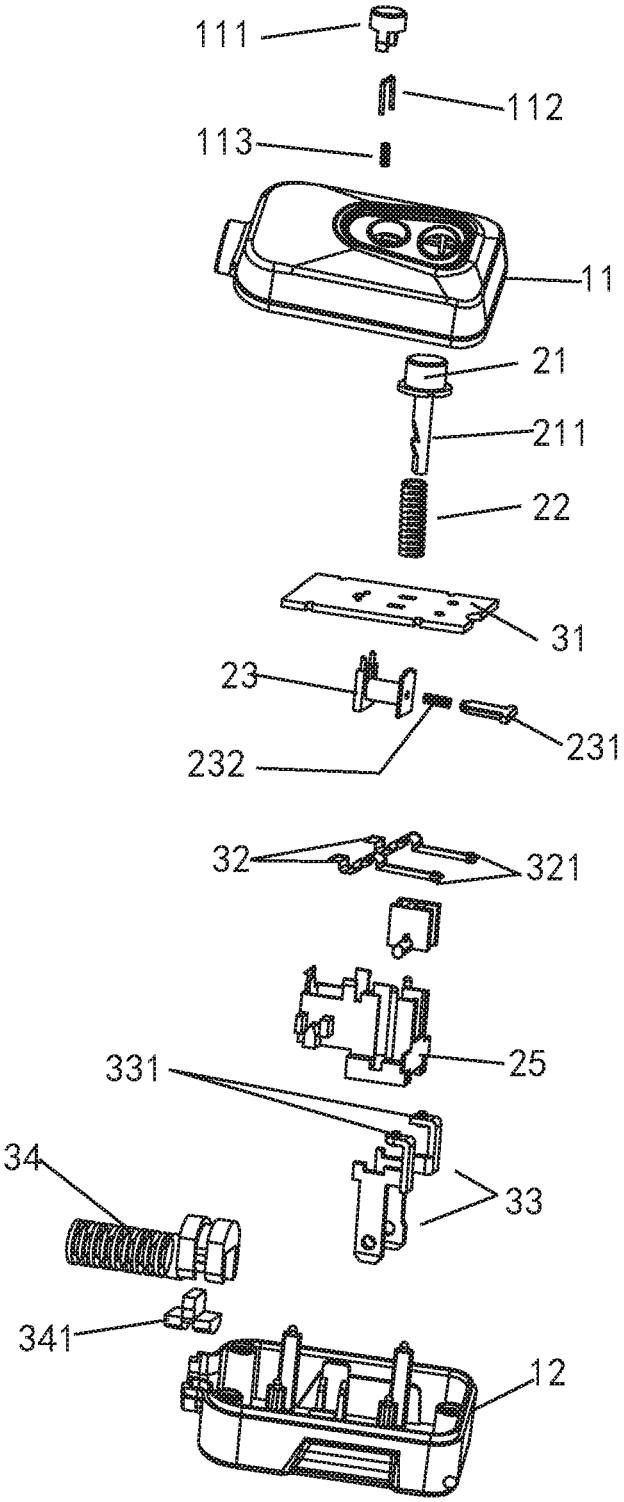
FIG. 2 is an exploded view of a leakage protective plug according to an embodiment of the present invention.
Figure 3:
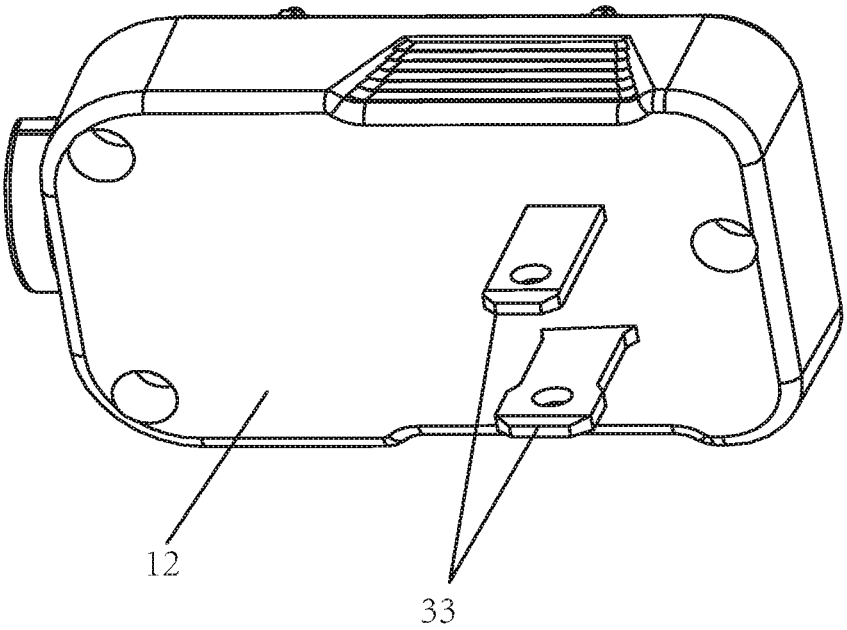
FIG. 3 is a schematic view of an assembled leakage protective plug according to an embodiment of the present invention.
Figure 4:
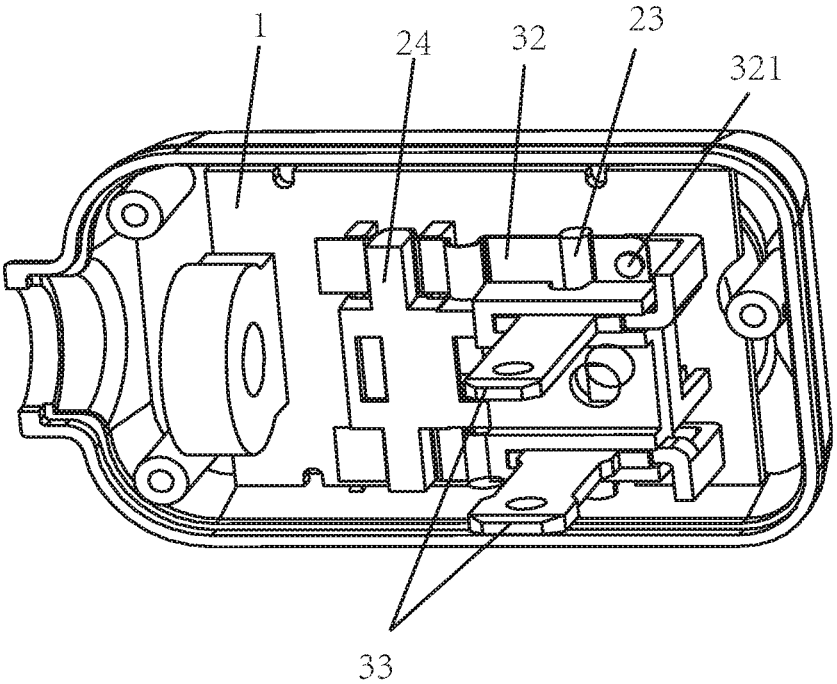
FIG. 4 is a schematic view of the leakage protective plug as shown in FIG. 3 according to the present invention, with the upper housing being removed.
Figure 5:
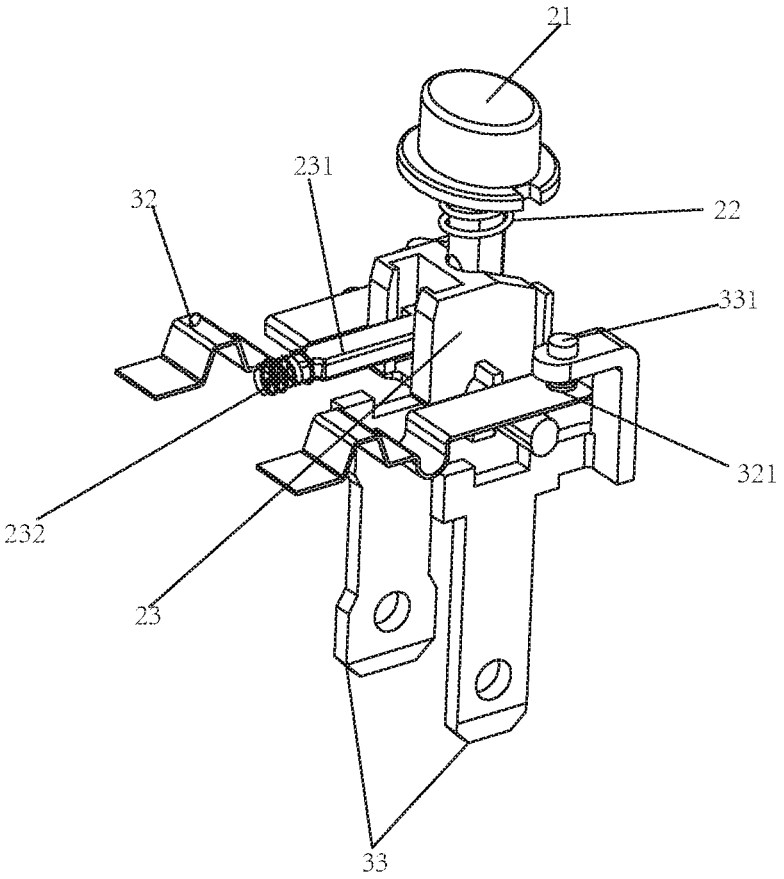
FIG. 5 is a schematic view of a tripping mechanism of a leakage protective plug (in a conducting state) according to an embodiment of the present invention, with the tripping bracket being removed.
Figure 6:
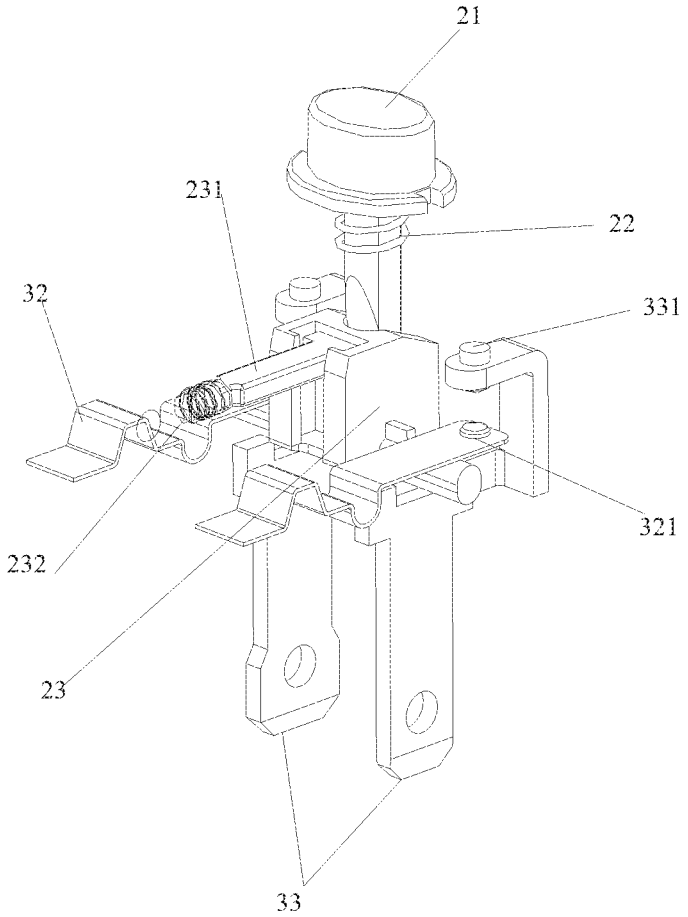
FIG. 6 is a schematic view of a tripping mechanism of a leakage protective plug (in a tripping state) according to an embodiment of the present invention, with the tripping bracket being removed.
Figure 7:
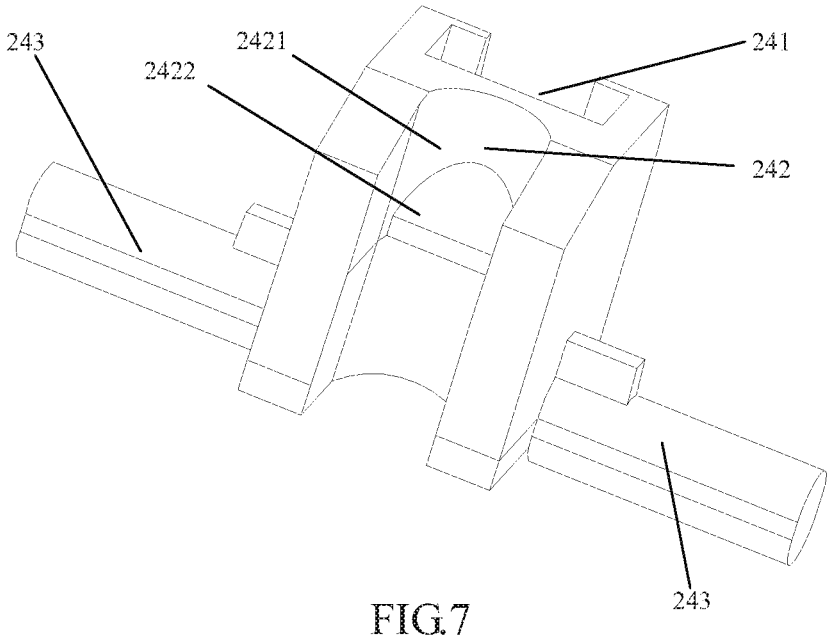
FIG. 7 is a schematic view of a pressing arm of a leakage protective plug according to an embodiment of the present invention.
Figure 8:
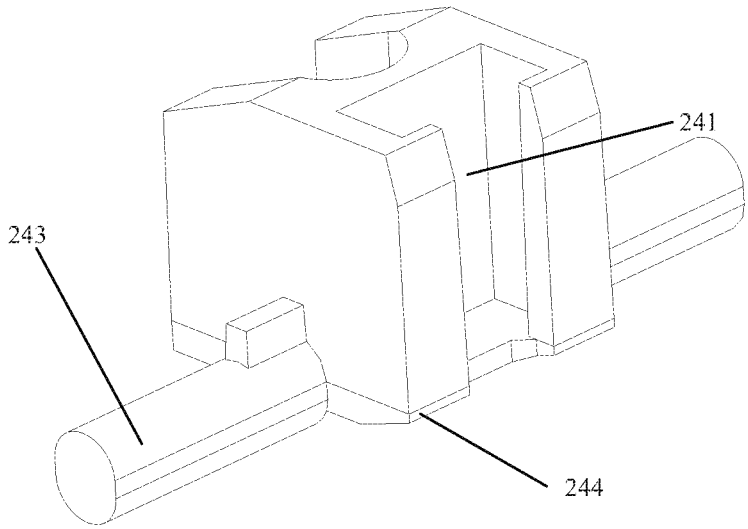
FIG. 8 is another schematic view of the pressing arm of the leakage protective plug according to the embodiment of the present invention.

Referring to FIGS. 2-8:

11. upper housing; 111. test button; 112. test bridge; 113. test spring; 12. lower housing;

21. reset button; 211. retaining groove; 22. reset spring; 23. tripping coil; 231. iron core; 232. spring; 24. pressing arm; 241. retaining sliding groove; 242. snap fitting mechanism; 2421. snap fitting sliding groove; 2422. snap fitting part; 243. arms; 244. slope; 25. tripping bracket;

31. circuit board; 32. movable contact springs for zero connection and fire wire connection; 321. movable contacts; 33. pins for zero connection and fire wire connection; 331. stationary contacts; 34. cutting sleeve for output lines; 341. snap joint.

In conjunction with the above, a leakage protective plug according to an embodiment of the present invention comprises: a housing, and a tripping mechanism and a conducting structure which are arranged within the housing.

Herein, the housing comprises an upper housing 11 and a lower housing 12, wherein the upper housing 11 comprises a test button 111, a test bridge 112, and a test spring 113, which are arranged within the upper housing 11.

The tripping mechanism comprises a reset button 21, a reset spring 22, a tripping coil 23, a pressing arm 24 and a tripping bracket 25, wherein a pressing bar 210 is arranged below the reset button 21, a retaining groove 211 is arranged on the pressing bar 210, and the tripping coil 23 comprises an iron core 231 and a spring 232.

The conducting structure comprises a circuit board 31, movable contact springs 32 for zero connection and fire wire connection, pins 33 for zero connection and fire wire connection, an cutting sleeve 34 for output lines, wherein the movable contact springs 32 for zero connection and fire wire connection comprise movable contacts 321 respectively arranged at a head on one end thereof, and in this embodiment two movable contacts 321 are provided. Herein, the pins 33 for zero connection and fire wire connection comprise stationary contacts 331 respectively arranged at a part on an upper end thereof away from the pins, and in this embodiment two stationary contacts 331 are provided. Herein, the cutting sleeve 34 for output lines is fixed inside the lower housing through a snap joint 341.

In this embodiment, the parts of the structure are connected in such a way that:

the upper housing 11 and the lower housing 12 are fixedly connected by screw thread or snap fitting so as to enclose a closed space in which the tripping mechanism and the conducting structure are arranged;

the reset button 21 is arranged in the upper housing 11 and is upwardly and downwardly movable along a vertical axis, the reset button 21 has an upper end crossing through the circuit board 31 and protruding from the upper housing 11 to form a press part; the reset spring 22 is sleeved on the pressing bar 210 of the reset button 21, with an upper end pressing against the underside of the top of the reset button 21 and a lower end pressing against the circuit board 31;

the iron core 231 and the spring 232 are arranged in a core of the tripping coil 23, wherein the iron core 231 is movable along a horizontal axis in the core of the tripping coil 23, the spring 232 has one end pressing against the rear part inside the core of the tripping coil 23 and the other end pressing against the head part of the iron core 231; furthermore, the head part of the iron core 231 is snap fitted in a retaining sliding groove 241 of the pressing arm 24 and is upwardly and downwardly slidable along the inside wall of the retaining sliding groove.

The other side of the pressing arm 24, which is opposite to the retaining sliding groove 241, is snap fitted with the retaining groove 211 of the reset button 21. The pressing arm 24 is provided with a snap fitting mechanism 242 corresponding to the retaining groove 211, and the snap fitting mechanism 242 of the pressing arm comprises a snap fitting sliding groove 2421 arranged in the pressing arm and a snap fitting part 2422 arranged in the snap fitting sliding groove. The reset button 21 is upwardly and downwardly movable in the snap fitting sliding groove 2421 and is snap fitted with the snap fitting part. Meanwhile, in the case that the snap fitting part 2422 of the snap fitting mechanism 242 is disengaged from the retaining groove 211, the pressing arm 24 is upwardly and downwardly movable and is rotatable in relative to the reset button 21. In the case that the iron core 231 is displaced forwardly under the spring force of the spring 232, the pressing arm 24 is axially rotated and is displaced forwardly in relative to the reset button 21, so as to enable the retaining groove 211 of the reset button 21 and the snap fitting mechanism 242 of the pressing arm 24 to be snapped together. Moreover, the pressing arm 24 is further provided with arms 243, which are respectively arranged on two sides adjacent to the retaining sliding groove 241.

Furthermore, the tripping bracket 25 is mounted on the circuit board 31, particularly by snap joint in this embodiment. The tripping coil 23 is installed in the opening of the tripping bracket 25. Opening sliding grooves are longitudinally arranged on two sides of the tripping bracket 25. The pressing arm 24 is arranged in the opening of the tripping bracket 25, at a side of the tripping coil 23. Two arms 243 of the pressing arm 24 are positioned in the longitudinal opening sliding grooves, and are upwardly and downwardly moveable and are axially rotatable in a small range. In the opening of the tripping bracket 25 accommodating the pressing arm 24, a space is provided so as to allow the pressing arm to be rotated by a certain angle. Furthermore, a slope 244 for allowing the pressing arm to be rotated by a certain angle is provided at an end portion on the underside of the pressing arm away from the snap fitting mechanism.

Rear parts of the movable contact springs 32 for zero connection and fire wire connection away from the movable contacts 321 are respectively installed on two sides of the tripping bracket 25. Front parts of the movable contact springs 32 for zero connection and fire wire connection, in which the movable contacts 321 are arranged, respectively press against the two arms 243 of the pressing arm 24.

The pins 33 for zero connection and fire wire connection are fixed on the tripping bracket 25, with two pins protruding from the housing 12. The pins 33 for zero connection and fire wire connection are provided with stationary contacts 331 which correspond to the movable contacts 321 and may come into contact with the movable contacts 321 so as to realize an electrical connection.

In using, the user may press down the press part formed on the upper end of the reset button 21. In the case that electric leakage does not occur, the head part of the iron core 231 abuts against the retaining sliding groove 241 of the pressing arm 24. As the reset button 21 is pressed down, the retaining groove 211 of the reset button 21 and the snap fitting part 2422 of the snap fitting mechanism 242 are snapped together. Under the force of the spring 232, the iron core 231 abuts the pressing arm 24 against the reset button 21 so that the engagement between the pressing arm 24 and the reset button 21 may be maintained. Meanwhile, in the case that the pressure for the reset button disappears, since the reset button 21 and the pressing arm 24 are snapped together, the pressing arm 24 is pulled by the reset button 21 and moved a short distance upwards under the force of the reset spring 22, so that the two arms 243 on the left and right sides of the pressing arm 24 drives the movable contacts 321 positioned at the heads of the movable contact springs 32 for zero connection and fire wire connection to move upwards simultaneously, thereby enabling a contact between the movable contacts 321 and the stationary contacts 331 and establishing an electric connection.

In the case that electric leakage occurs, a current is generated in the tripping coil 23, then a magnetic field is generated and forces the iron core 231 to move rearwards. The pressing arm 24 is pulled by the head of the iron core 231 and moved rearwards, so that the pressing arm 24 is axially rotated in a small range. Thus, the snap fitting part of the snap fitting mechanism 242 of the pressing arm 24 disengages from the retaining groove 211 of the reset button 21, and then the reset button 21 is moved upwards under the acting force of the reset spring 22. Meanwhile, the two arms of the pressing arm 24 are pushed by the movable contact springs 32 for zero connection and fire wire connection under the spring force of the movable contact springs and moved downwards simultaneously. Thereby, the movable contacts 321 and the stationary contacts 331 are separated from each other, and thus risks caused by electric leakage are eliminated.

The tripping mechanism provided in the present embodiment omits some components such as the tripping plate of the existing plug, and meanwhile achieves leakage protection by tripping. It not only simplifies the structure and greatly saves raw materials, but also avoids technical problems including poor contact of supply circuit and failure of power leakage protecting functions due to un-complete tripping which are resulted from the deformation of the tripping plate caused by external forces.

The present invention is not limited to the above disclosed and described particular embodiments. On the basis of the above disclosure, those skilled in the art may change or modify the above disclosed technical contents to obtain equivalent embodiments without departing from the scope of the present invention. Although this invention has been described with some particular terms, it is to be understood that such terms are intended to be illustrative rather than limiting.

What is claimed is:

1. A leakage protective plug, characterized in that: it comprises a housing, and a tripping mechanism and a conducting structure which are arranged within the housing, wherein the tripping mechanism comprises a restorable reset button, a tripping bracket, and a tripping coil and a pressing arm which are arranged in the tripping bracket, wherein the reset button is sleeved in the pressing arm, a snap fitting mechanism is positioned in the pressing arm for snapping the pressing arm and the reset button together, and the pressing arm and the reset button are disengageable under the control of the tripping coil, wherein the snap fitting mechanism of the pressing arm comprises a snap fitting sliding groove arranged in the pressing arm and a snap fitting part arranged in the snap fitting sliding groove, and the reset button is upwardly and downwardly slidable in the snap fitting sliding groove and is snap fitted with the snap fitting part.

2. The leakage protective plug according to claim 1, characterized in that: the pressing arm is rotatable for an angle under the control of the tripping coil, so as to allow disengagement of the pressing arm from the reset button.

3. The leakage protective plug according to claim 2, characterized in that: a slope for allowing the pressing arm to rotate an angle is provided at an end portion on the underside of the pressing arm away from the snap fitting mechanism.

4. The leakage protective plug according to claim 1, characterized in that: an iron core and a spring are arranged within the tripping coil, the pressing arm is provided with a retaining sliding groove on the other side opposite to the snap fitting mechanism, a head part of the iron core is snap fitted in the retaining sliding groove of the pressing arm and is upwardly and downwardly slidable along the inside wall thereof.

5. The leakage protective plug according to claim 1, characterized in that: the reset button is restorable by a reset spring arranged below the reset button.

6. The leakage protective plug according to claim 5, characterized in that: a pressing bar is arranged below the reset button, a reset spring is sleeved on the pressing bar, the pressing bar is arranged with a retaining groove, and the retaining groove and the snap fitting mechanism of the pressing arm are capable of being snapped together.

7. The leakage protective plug according to claim 1, characterized in that: the pressing arm is provided with arms on two sides, respectively, the tripping bracket is provided with an opening sliding groove, and two arms of the pressing arm are positioned in the longitudinal opening sliding groove.

8. The leakage protective plug according to claim 7, characterized in that: the conducting structure comprises a circuit board, movable contact springs for zero connection and fire wire connection, and pins for zero connection and fire wire connection, wherein the heads of the movable contact springs for zero connection and fire wire connection are movable contacts, the upper ends of the pins for zero connection and fire wire connection are stationary contacts, and the stationary contacts and the movable contacts correspond with each other and are contactable with each other.

9. The leakage protective plug according to claim 8, characterized in that: rear parts of the movable contact springs for zero connection and fire wire connection away from the movable contacts are respectively installed on two sides of the tripping bracket, and the parts with which the movable contacts are connected respectively abut against the two arms of the pressing arm.

10. The leakage protective plug according to claim 8, characterized in that: the pins for zero connection and fire wire connection are fixed on the tripping bracket, with two pins protruding from the lower housing.

11. A tripping mechanism for a leakage protective plug, characterized in that: the tripping mechanism comprises a restorable reset button, a tripping bracket, and a tripping coil and a pressing arm which are arranged in the tripping bracket, wherein the reset button is sleeved in the pressing arm, a snap fitting mechanism is positioned in the pressing arm for snapping the pressing arm and the reset button together, and the pressing arm and the reset button are disengageable under the control of the tripping coil, wherein the snap fitting mechanism of the pressing arm comprises a snap fitting sliding groove arranged in the pressing arm and a snap fitting part arranged in the snap fitting sliding groove, and the reset button is upwardly and downwardly slidable in the snap fitting sliding groove and is snap fitted with the snap fitting part.

12. The tripping mechanism for a leakage protective plug according to claim 11, characterized in that: the pressing arm is rotatable for an angle under the control of the tripping coil, so as to allow disengagement of the pressing arm from the reset button.

13. The tripping mechanism for a leakage protective plug according to claim 12, characterized in that: a slope for allowing the pressing arm to rotate an angle is provided at an end portion on the underside of the pressing arm away from the snap fitting mechanism.

14. The tripping mechanism for a leakage protective plug according to claim 11, characterized in that: an iron core and a spring are arranged within the tripping coil, the pressing arm is provided with a retaining sliding groove on the other side opposite to the snap fitting mechanism, a head part of the iron core is snap fitted in the retaining sliding groove of the pressing arm and is upwardly and downwardly slidable along the inside wall thereof.

15. The tripping mechanism for a leakage protective plug according to claim 11, characterized in that: the reset button is restorable by a reset spring arranged below the reset button.

16. The tripping mechanism for a leakage protective plug according to claim 15, characterized in that: a pressing bar is arranged below the reset button, a reset spring is sleeved on the pressing bar, the pressing bar is arranged with a retaining groove, and the retaining groove and the snap fitting mechanism of the pressing arm are capable of being snapped together.

17. The tripping mechanism for a leakage protective plug according to claim 11, characterized in that: the pressing arm is provided with arms on two sides, respectively, the tripping bracket is provided with an opening sliding groove, and two arms of the pressing arm are positioned in the longitudinal opening sliding groove.

* * * * *